US007887650B2

(12) United States Patent
Kitayama et al.

(10) Patent No.: US 7,887,650 B2
(45) Date of Patent: Feb. 15, 2011

(54) GAS GENERATING COMPOSITION

(75) Inventors: Kenji Kitayama, Tatsuno (JP); Shogo Tomiyama, Tatsuno (JP)

(73) Assignee: Daicel Chemical Industries, Ltd., Sakai-Shi (JP)

( * ) Notice: Subject to any disclaimer, the term of this patent is extended or adjusted under 35 U.S.C. 154(b) by 550 days.

(21) Appl. No.: 11/680,748

(22) Filed: Mar. 1, 2007

(65) Prior Publication Data

US 2007/0204942 A1 Sep. 6, 2007

Related U.S. Application Data

(60) Provisional application No. 60/779,456, filed on Mar. 7, 2006, provisional application No. 60/792,624, filed on Apr. 18, 2006.

(30) Foreign Application Priority Data

Mar. 2, 2006 (JP) ..... 2006-056134
Apr. 4, 2006 (JP) ..... 2006-102889

(51) Int. Cl.
*C06B 45/00* (2006.01)
*C06B 31/00* (2006.01)
*C06B 27/00* (2006.01)
*D03D 23/00* (2006.01)
*D03D 43/00* (2006.01)

(52) U.S. Cl. ..... 149/37; 149/2; 149/45; 149/87; 149/108.2; 149/109.4

(58) Field of Classification Search ..... 149/37, 149/2, 45, 87, 108.2, 109.4
See application file for complete search history.

(56) References Cited

U.S. PATENT DOCUMENTS

| | | | | |
|---|---|---|---|---|
| 2,637,274 | A * | 5/1953 | Taylor et al. | 102/290 |
| 3,240,640 | A * | 3/1966 | Ives | 149/19.91 |
| 6,365,766 | B1 * | 4/2002 | Aramata et al. | 556/472 |
| 7,459,043 | B2 * | 12/2008 | Blau et al. | 149/109.4 |
| 2002/0053377 | A1 * | 5/2002 | Martin et al. | 149/17 |
| 2004/0094250 | A1 | 5/2004 | Dixon et al. | |
| 2005/0127324 | A1 | 6/2005 | Wu | |
| 2005/0155681 | A1 * | 7/2005 | Wu | 149/36 |

FOREIGN PATENT DOCUMENTS

| | | | |
|---|---|---|---|
| EP | 1415962 | A1 | 5/2004 |
| JP | 2002-522330 | A | 7/2002 |
| JP | 2005-126262 | A | 5/2005 |
| WO | WO-00/07846 | A1 | 2/2000 |
| WO | WO-03/016244 | A1 | 2/2003 |

* cited by examiner

*Primary Examiner*—Jerry Lorengo
*Assistant Examiner*—James E McDonough
(74) *Attorney, Agent, or Firm*—Birch, Stewart, Kolasch & Birch, LLP

(57) ABSTRACT

The present invention provides a gas generating composition comprising a fuel and an oxidizing agent and further a copper powder.

20 Claims, No Drawings

GAS GENERATING COMPOSITION

This nonprovisional application claims priorities under 35 U.S.C. §119(a) on Patent Application No. 2006-56134 filed in Japan on 2 Mar. 2006 and Patent Application No. 2006-102889 filed in Japan on 4 Apr. 2006 and 35 U.S.C. §119(e) on U.S. Provisional Application No. 60/779,456 filed on 7 Mar. 2006 and U.S. Provisional Application No. 60/792,624 filed on 18 Apr. 2006, which are incorporated by reference.

BACKGROUND OF THE INVENTION

1. Field of Invention

The present invention relates to a gas generating composition suitable for an airbag restriction system for an automobile and the like.

2. Description of Related Art

Gas generating agents typically generate a large amount of ultrafine combustion residues and mist (floating particles which are generated by combustion of the gas generating agent and that are composed of solid components, such as metal components, present in the gas generating agent) after combustion. Because the combustion residue and mist, which have been just produced, carry heat, there is a risk of damaging the airbag and causing the occupants to get burned if the combustion residue and mist are released into an airbag. Further, if the airbag is damaged, the combustion residues and mist are released into the vehicle cabin. In order to avoid such a risk, a fine-mesh metallic filter is disposed inside the inflator.

However, the filter is the largest mass part among inflator components. Gas purification can be obtained by the filter. On the other hand, there exists a problem of increase in mass and size of the inflator.

SUMMARY OF INVENTION

The present invention provides a gas generating composition including a fuel, an oxidizing agent and further a copper powder.

DETAILED DESCRIPTION OF INVENTION

As a method for reducing the size and mass of the filter, decreasing the combustion temperature of the gas generating agent can be considered. US-A No. 2004-94250, JP-A No. 2005-126262, JP-A No. 2002-522330 and WO-A No. 03/016244 describe that a copper compound powder is blended as an oxidizing agent or additive.

The present invention is to decrease the amount of combustion residues and mist and purify the gas by using a copper powder that is not disclosed in US-A No. 2004-94250, JP-A No. 2005-126262, JP-A No. 2002-522330 and WO-A No. 03/016244 to decrease the combustion temperature of the gas generating composition.

The copper powder in accordance with the present invention is a powder containing only copper, and no powder of copper compounds is included.

Because the gas generating composition in accordance with the present invention has a low combustion temperature, the amount of combustion residue and mist generated during combustion is small and the amount of generated carbon monoxide and $NH_3$ is also small.

The gas generating composition in accordance with the present invention includes a copper powder, and other components thereof can be selected from fuels, oxidizing agents, binders, and additives that have been used in the known gas generating compositions. The copper powder decreases the combustion temperature of the gas generating composition and acts to decrease the amount of $NH_3$ and carbon monoxide and the like generated after combustion.

The copper powder preferably has a mean particle size of 0.5 to 500 μm, more preferably 1 to 300 μm, and even more preferably 5 to 30 μm.

The mean particle size is measured by a particle size distribution method using laser scattered light. The measurement sample is prepared by dispersing a basic metal nitrate in water and irradiating this for 3 minutes with ultrasonic wave radiation. A 50% accumulation value (D50) of the number of particles is found and an average value obtained for two cycles of measurements is taken as a mean particle size.

The copper powder preferably has a specific surface area determined by a BET method of 100 to 20,000 $cm^2/g$, more preferably 500 to 10,000 $cm^2/g$, and even more preferably 1,000 to 5,000 $cm^2/g$.

By relating the mean particle size with the specific surface area and setting them in the predetermined ranges, handling of the copper powder in the manufacturing process is improved, the amount of mist is reduced, and the exhaust gas is purified, effectively.

The copper powder is preferably an electrolytic copper powder. The electrolytic copper powder is obtained by electrolysis in a copper nitrate solution and particles thereof have a dendritic shape. A variety of products marketed by Mitsui Mining & Smelting Co., Ltd. (Mitsui Kinzoku) and Nippon Mining & Metals Co., Ltd. (Former Nikko Materials Co., Ltd.) can be used as the electrolytic copper powder.

The content ratio of the copper powder in the gas generating composition is preferably 0.1 to 50 mass %, more preferably 0.2 to 40 mass %, even more preferably 0.5 to 30 mass %, and most preferably 2.0 to 25 mass %.

At least one selected from tetrazole compounds, guanidine compounds, triazine compounds, and nitroamine compounds can be used as the fuel.

Preferred tetrazole compounds are 5-aminotetrazole and bitetrazole ammonium salt. Preferred guanidine compounds are guanidine salt of nitric acid (guanidine nitrate), aminoguanidine salt of nitric acid, nitroguanidine, and triaminoguanidine salt of nitric acid. Preferred triazine compounds are melamine, Cyanuric acid, ammeline, ammelide and ammelande. A preferred nitroamine compound is cyclo-1,3,5-trimethylene-2,4,6-trinitramine.

At least one selected from basic metal nitrates, nitrates, ammonium nitrate, perchlorates, and chlorates can be used as the oxidizing agent.

At least one selected from basic copper nitrate, basic cobalt nitrate, basic zinc nitrate, basic manganese nitrate, basic iron nitrate, basic molybdenum nitrate, basic bismuth nitrate, and basic cerium nitrate can be used as the basic metal nitrate.

In order to increase the burning rate, the basic metal nitrate preferably has a mean particle size of 30 μm or less, more preferably 10 μm or less. The mean particle size is measured by a particle size distribution method using laser scattered light. The measurement sample is prepared by dispersing a basic metal nitrate in water and irradiating this for 3 minutes with ultrasonic wave radiation. A 50% accumulation value (D50) of the number of particles is found and an average value obtained for two cycles of measurements is taken as a mean particle size.

Examples of nitrates include alkali metal nitrates such as potassium nitrate and sodium nitrate, and alkaline earth metal nitrates such as strontium nitrate.

The perchlorate and chlorate are the components producing an oxidizing action and combustion enhancing action.

The oxidizing action means an action that advances the combustion efficiently by generating oxygen during the combustion and also reduces the amount of generated hazardous gases such as ammonia and carbon monoxide. On the other hand, the combustion enhancing action means an action that increases the combustibility of the gas generating composition or an action that increases the burning rate.

At least one selected from ammonium perchlorate, potassium perchlorate, sodium perchlorate, potassium chlorate, and sodium chlorate can be used as the perchlorate and chlorate.

The binder can be at least one selected from carboxymethyl cellulose, carboxymethyl cellulose strontium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethyl hydroxyethyl cellulose, hydroxypropylcellulose, carboxymethylethylcellulose, microcrystalline cellulose, polyacrylamide, polyacrylamide amino compound, polyacryl hydrazide, copolymers of acrylamide and a metal salt of acrylic acid, a copolymer of polyacrylamide and ester compound of polyacrylic acid, polyvinyl alcohol, acrylic rubber, guar gum, starch, and silicone.

The additive can be at least one selected from metal oxides such as copper oxide, iron oxide, zinc oxide, cobalt oxide, manganese oxide, molybdenum oxide, nickel oxide, bismuth oxide, silica, and alumina; metal carbonates or basic metal carbonates such as cobalt carbonate, calcium carbonate, basic zinc carbonate, and basic copper carbonate; complex compounds of metal oxides or hydroxides such as Japanese acid clay, kaolin, talc, bentonite, diatomaceous earth, and hydroxytalcite; aluminum hydroxide, magnesium hydroxide; metallic acid salts such as sodium silicate, mica molybdate, cobalt molybdate, and ammonium molybdate, molybdenum disulfide, calcium stearate, silicon nitride, and silicon carbide.

No specific limitation is placed on the content ratio of compounds other than copper powder. For example, the content ratio can be set within the same range as the content ratio of organic compounds as fuel, oxygen-containing oxidizing agents, a binder, and an additive selected from metal oxides and metal carbonates described in JP-A No. 2005-126262. The content ratios disclosed in JP-A No. 2005-126262 are incorporated herein by reference.

An example of the gas generating composition in accordance with the present invention may be the gas generating composition of Formulation Example 1 having the below-described composition. The gas generating composition of Formulation Example 1 generates smaller amount of carbon monoxide or $NH_3$ and has smaller amount of generated combustion residues.

FORMULATION EXAMPLE 1

Fuel (for example, guanidine nitrate): 5 to 60 mass %, preferably 10 to 55 mass %.

Oxidizing agent (for example, basic copper nitrate): 10 to 85 mass %, preferably 20 to 75 mass %.

Additive (for example, aluminum hydroxide): 0.2 to 20 mass %, preferably 1 to 15 mass %.

Copper powder: 0.1 to 50 mass %, preferably 0.2 to 40 mass %.

The gas generating composition in accordance with the present invention can be molded into a desired shape and can be produced as a molded article in a shape of a single-perforated column, multi-perforated column, or pellet.

Such a molded article can be manufactured by a method in which water or an organic solvent is added to and mixed with a gas generating composition and the mixture is extrusion-molded (in the case of a molded article in a shape of a single-perforated column, multi-perforated column) or a method in which compression molding is performed by using a pelletizer (in the case of a molded article in a shape of pellet). The molded article in a shape of a single-perforated column, multi-perforated column may have a hole penetrating in the lengthwise direction or a hollow that does not penetrate.

The gas generating composition in accordance with the present invention or a molded article obtained therefrom can be applied to, for example, an airbag inflator for a driver side, airbag inflator for passenger side next to the driver, inflator for a side airbag, inflator for an inflatable curtain, inflator for a knee bolster, inflator for an inflatable seat belt, inflator for a tubular system, and gas generator for a pretensioner mounted in various vehicles.

The inflator using the gas generating composition in accordance with the present invention or a molded article obtained therefrom may be of a pyrotechnic type in which gas is supplied only from the gas generating agent, or a hybrid type in which both a compressed gas such as argon and the gas generating agent are used.

Further, the gas generating composition in accordance with the present invention or a molded article obtained therefrom can be also used as an ignition agent so-called an enhancer agent (or booster) for transferring the energy of detonator or squib to the gas generating agent.

EXAMPLES

The present invention will be described below in greater detail based on Examples, but the present invention is not limited to these Examples.

Examples and Comparative Examples

The gas generating compositions (powders) shown in Table 1 were used in an amount of 2 g and molded into strands.

(1) Composition of the Generated Gas

The gas generating composition (powder) shown in Table 1 was used in an amount of 2 g and molded into a strand. The strand was attached to a sealed cylinder having an inner capacity of one liter, the atmosphere inside the cylinder was replaced with nitrogen, the nitrogen was compressed to 6860 kPa, and the strand was ignited by electrifying a nichrome wire and completely combusted. In about 20 seconds after electrifying, the combustion gas was sampled into a gas sampling bag and the concentration of NO, CO, and $NH_3$ (ppm by mass) was immediately analyzed.

(2) Evaluation of Slag State

The gas generating composition (powder) shown in Table 1 was used in an amount of 2 g and molded into a strand. The strand was attached to a sealed cylinder with having inner capacity of one liter, the atmosphere inside the cylinder was replaced with nitrogen, the nitrogen was compressed to 6860 kPa, and the strand was ignited by electrifying a nichrome wire and completely combusted. After combustion, the combustion residue (slag) was taken out from the cylinder and the slag state was analyzed based on the following criteria.

○: the slag does not collapse even when pressed with a finger and the shape of the molded article of the gas generating composition before the combustion is maintained at almost the same level;

Δ: the slag partially collapses when pressed with a finger; and

X: brake into fine grains.

TABLE 1

| | Gas Generating Composition (mass %) | | | | | | Gas Concentration (ppm) | | | | Slag |
|---|---|---|---|---|---|---|---|---|---|---|---|
| | GN | BCN | Cu-1 (20 μm) | Cu-2 (50 nm) | CMCNa | $Al(OH)_3$ | $NO_2$ | NO | $NH_3$ | CO | Evaluation |
| Comparative Ex.1 | 40.71 | 49.29 | — | — | 5.00 | 5.00 | 0 | 60 | 6 | 340 | X |
| Comparative Ex.2 | 32.20 | 44.20 | — | 14.90 | 4.80 | 3.90 | 0 | 110 | 12 | 300 | Δ |
| Ex.1 | 36.50 | 48.60 | 4.90 | — | 5.00 | 5.00 | 0 | 155 | 2 | 210 | ○ |
| Ex.2 | 32.20 | 44.20 | 14.90 | — | 4.80 | 3.90 | 0 | 180 | 3 | 170 | ○ |
| Ex.3 | 26.30 | 39.70 | 25.00 | — | 5.00 | 4.00 | 0 | 150 | 4 | 140 | ○ |

GN: guanidine nitrate.

BCN: basic copper nitrate.

Cu-1: copper powder, mean particle size 20 μm, specific surface area 3300 $cm^2/g$, #6, manufactured by Nippon Mining & Metals Co., Ltd. (Former Nikko Materials Co., Ltd.).

Cu-2: copper powder, mean particle size 50 nm (prepared product), specific surface area 120,000 $cm^2/g$.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A gas generating composition comprising:

at least one fuel;

at least one oxidizer;

at least one binder, and 2.0 mass % to 25 mass % of electrolytic copper powder having a mean particle size of 5 μm to 30 μm.

2. The gas generating composition according to claim 1, wherein a specific surface area of the copper powder determined by a BET method is 100 to 20,000 $cm^2/g$.

3. A gas generating composition comprising:

at least one fuel;

at least one oxidixer;

at least one binder;

2.0 mass % to 25 mass % of electrolytic copper powder having a mean particle size of 5 μm to 30 μm; and at least one additive selected from the group consisting of metal oxides, metal carbonates, complex compounds of metal oxides or hydroxides, molybdenum disulfide, silicon nitride, and silicon carbide.

4. The gas generating composition according to claim 3, wherein the additive is selected from metal carbonates.

5. The gas generating composition according to claim 1, wherein said oxidizer consists of at least one of basic copper nitrate, basic cobalt nitrate, basic zinc nitrate, basic manganese nitrate, basic iron nitrate, basic molybdenum nitrate, basic bismuth nitrate, basic cerium nitrate, potassium nitrate, sodium nitrate, and strontium nitrate.

6. The gas generating composition according to claim 3, wherein said oxidizer consists of at least one of basic copper nitrate, basic cobalt nitrate, basic zinc nitrate, basic manganese nitrate, basic iron nitrate, basic molybdenum nitrate, basic bismuth nitrate, basic cerium nitrate, potassium nitrate, sodium nitrate, and strontium nitrate.

7. The gas generating composition according to claim 1, wherein the composition contains 10 mass % to 55 mass % fuel and 20 mass % to 75 mass % oxidizer, the fuel is guanidine nitrate, and the oxidizer is basic copper nitrate.

8. The gas generating composition according to claim 3, wherein the composition contains 10 mass % to 55 mass % fuel and 20 mass % to 75 mass % oxidizer, the fuel is guanidine nitrate, and the oxidizer is basic copper nitrate.

9. The gas generating composition according to claim 1, wherein the fuel is guanidine nitrate, the oxidizer is basic copper nitrate, and the binder is a carboxymethyl cellulose salt.

10. The gas generating composition according to claim 3, wherein the fuel is guanidine nitrate, the oxidizer is basic copper nitrate, and the binder is a carboxymethyl cellulose salt.

11. A gas generating composition comprising:

at least one fuel;

at least one oxidizer;

at least one binder;

2.0 mass % to 25 mass % of electrolytic copper powder having a mean particle size of 5 μm to 30 μm; and, optionally, at least one additive selected from the group consisting of metal oxides, metal carbonates, complex compounds of metal oxides or hydroxides, molybdenum disulfide, silicon nitride, and silicon carbide.

12. The composition according to claim 1, wherein the at least one fuel is selected from the group consisting of tetrazole compounds, guanidine compounds, triazine compounds, and nitroamine compounds.

13. The composition according to claim 1, wherein the at least one oxidizer is a basic metal nitrate.

14. The composition according to claim 1, wherein the at least one binder is selected from the group consisting of carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethyl hydroxyethyl cellulose, hydroxypropylcellulose, carboxymethylethylcellulose, microcrystalline cellulose, polyacrylamide, polyacrylamide amino compound, polyacryl hydrazide, a copolymer of acrylamide and a metal salt of acrylic acid, a copolymer of polyacrylamide and an ester compound of polyacrylic acid, acrylic rubber, guar gum, starch, and silicone.

15. The composition according to claim 3, wherein the at least one fuel is selected from the group consisting of tetrazole compounds, guanidine compounds, triazine compounds, and nitroamine compounds.

16. The composition according to claim 3, wherein the at least one oxidizer is a basic metal nitrate.

17. The composition according to claim 3, wherein the at least one binder is selected from the group consisting of carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethyl hydroxyethyl cellulose, hydroxypropylcellulose, carboxymethylethylcellulose, microcrystalline cellulose, polyacrylamide, polyacrylamide amino compound, polyacryl hydrazide, a copolymer of acrylamide and a metal salt of acrylic acid, a copolymer of polyacrylamide and an ester compound of polyacrylic acid, acrylic rubber, guar gum, starch, and silicone.

18. The composition according to claim 11, wherein the at least one fuel is selected from the group consisting of tetrazole compounds, guanidine compounds, triazine compounds, and nitroamine compounds.

19. The composition according to claim 11, wherein the at least one oxidizer is a basic metal nitrate.

20. The composition according to claim 11, wherein the at least one binder is selected from the group consisting of carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethyl hydroxyethyl cellulose, hydroxypropylcellulose, carboxymethylethylcellulose, microcrystalline cellulose, polyacrylamide, polyacrylamide amino compound, polyacryl hydrazide, a copolymer of acrylamide and a metal salt of acrylic acid, a copolymer of polyacrylamide and an ester compound of polyacrylic acid, acrylic rubber, guar gum, starch, and silicone.

* * * * *